United States Patent [19]

Cazanas

[11] 4,205,521

[45] Jun. 3, 1980

[54] DECORATIVE CLOCK

[75] Inventor: Virgilio F. Cazanas, Miami, Fla.

[73] Assignee: Victoria Torres, Hialeah, Fla.

[21] Appl. No.: 779,758

[22] Filed: Mar. 21, 1977

[51] Int. Cl.[2] ..... G04B 19/30

[52] U.S. Cl. ..... 368/80; 40/553; 272/8 M; 368/276

[58] Field of Search ..... 272/13, 8 M, 8 R, 8 P, 272/8.5; 40/132 R, 132 D, 130 B; 58/53, 45, 50 R

[56] References Cited

U.S. PATENT DOCUMENTS

| | | | |
|---|---|---|---|
| 2,222,301 | 11/1940 | Rappaport | 272/13 |
| 2,534,877 | 12/1950 | Owen | 58/50 R |
| 4,139,955 | 2/1979 | Reiback | 40/219 |

*Primary Examiner*—Gene Z. Rubinson
*Assistant Examiner*—L. W. Pojunas, Jr.

[57] ABSTRACT

A lighted clock comprising an annular chamber defining frame, a septum separating the frame into a forward and rearward chamber portion, a clock arranged in the rearward portion and extending through the septum with the hands arranged in the forward chamber portion for rotation on the shaft of the clock, and said septum comprising a mirror in the forward chamber and said forward chamber being spanned in spaced relation from the mirror by a reflective glass, and an annular ring of lights between the mirror and the reflective glass and arranged about the clock hands to create an elusion of depth by light rays being reflected by the reflective glass and the mirror.

3 Claims, 2 Drawing Figures

DECORATIVE CLOCK

FIELD OF THE INVENTION

This invention relates to an improved clock which is decorative.

BACKGROUND OF THE INVENTION

In the past, there have been numerous types of clocks. This is of an improved highly decorative clock. It is composed of a mirror arranged within the central zone of a frame and a chamber defined between the mirror and a light reflective glass so that light rays impinging on the mirror are reflected between the reflective glass and the mirror and wherein an annular ring of light sources are arranged in the forward chamber about a pair of clock hands on the clock motor.

It is, accordingly, an object of this invention to provide a highly decorative clock which appears to create an illusion of great depth by reason of light rays action upon a mirrored surface and a reflective surface creating an unusual illusion of depth.

In accordance with these and other objects which will become apparent hereinafter, the instant invention will now be described with reference to the accompanying drawings, in which:

DESCRIPTION OF PREFERRED EMBODIMENT

Figure 1:
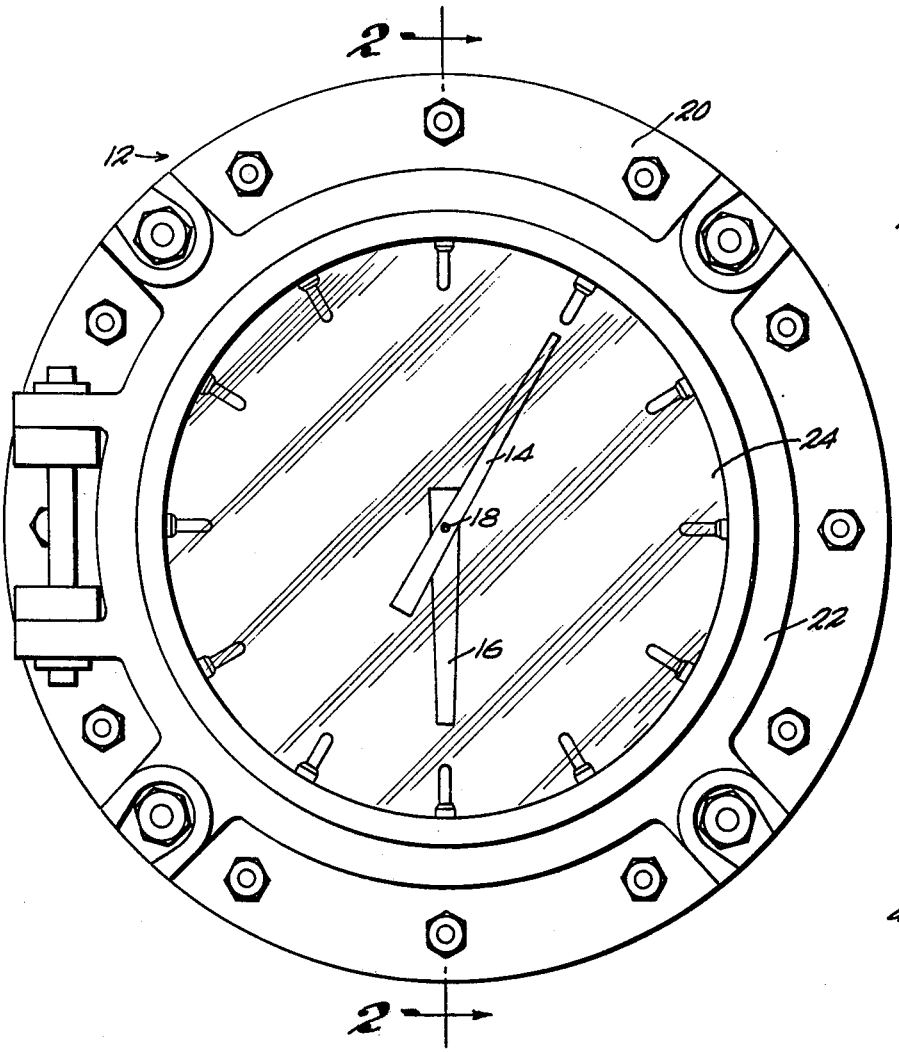
FIG. 1 is a front face view of a clock.
Figure 2:
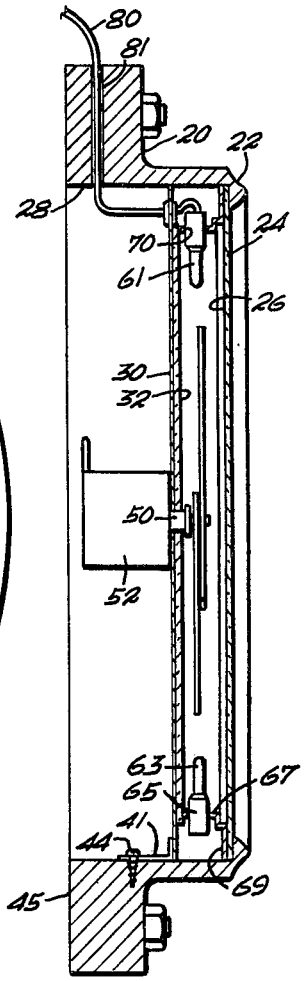
FIG. 2 is a view in cross section taken on the plane indicated by the line 2—2 of FIG. 1 and looking in the direction of the arrows.

Referring to the drawings wherein like reference characters designate like or corresponding parts throughout the several views and referring particularly to FIG. 1, there is shown a clock 12 wherein the hands 14 and 16 are arranged to travel in clock-like fashion on an appropriate and conventional spindle 18. As seen in FIG. 2, the clock includes a frame 20 which is generally annular and includes a front face 22 with an opening which is spanned by a glass plate 24 with an inside reflective coated surface 26 so as to be partially reflective. Within the chamber defined by the annular wall 28 there is a septum 30 with a mirror 32 on the surface facing outwardly, that is toward the reflective glass covering the frame. Suitable clip means such as that L-shaped member 41 which is secured as by screws 44 maintain the septum means so as to define a space between the rear face 45 and the septum and, through the septum and the mirror 32 there is an opening. Through this opening the shaft 50 of a clock 52 extends and on the shaft the hands 14 and 16 are mounted on the spindle 18. Between the reflective glass 24 and the mirror, an annular ring of lights, generally designated by the numerals 61 and 63 is provided, the lights being in holders such as 65 which are seated in a ring 67 having a portion 69 which abuts the glass and the portion 70 which abuts the septum means or mirror. The bulbs are energized by a conductor 80 which leads through a suitable opening such as 81 to connect to a source not shown. Similarly, the clock motor 52 is energized either by a battery or by a conductor, not shown, which connects to a source, not shown.

What is claimed is:

1. An illuminated wall clock having an illusion of depth comprising a frame defining an annular recess, septum means spanning the recess and separating the latter into front and rear chambers, a mirror carried by said septum means facing said front chamber and defining a rear wall thereof, a central opening in said septum means and mirror communicating said front with said rear chamber, a partially reflective mirror spaced from and in parallel relation to said first mentioned mirror mounted in said frame defining a front wall of said front chamber, clock means mounted in said rear chamber obscured by said first mentioned mirror and having a spindle extending through said central opening, clock hands mounted on said spindle and actuated by said clock means, said clock hands being located in said front chamber spaced between said walls, and a plurality of spaced sockets and electric light bulbs located around the periphery of and within said front chamber, said light bulbs when lighted serving to illuminate said clock hands and creating a tunnel effect of depth within which said hands are framed and repeatedly reflected in said mirror.

2. The illuminated wall clock defined in claim 1 including an annular ring fitting the interior of said frame and mounting said sockets, said ring being retained in position by a snug fit between said front chamber front and rear walls.

3. The illuminated wall clock defined in claim 1 in which said spaced sockets and light bulbs are twelve in number, one being located to designate an hour of time and each arranged to project radially inwardly toward said spindle.

* * * * *